US011493886B2

(12) United States Patent
Gueissaz et al.

(10) Patent No.: US 11,493,886 B2
(45) Date of Patent: Nov. 8, 2022

(54) WATCH PROVIDED WITH A CONTROL MEMBER

(71) Applicant: The Swatch Group Research and Development Ltd, Marin (CH)

(72) Inventors: François Gueissaz, Cormondreche (CH); Yvan Ferri, Lausanne (CH); Simon Bourquin, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 113 days.

(21) Appl. No.: 17/060,275

(22) Filed: Oct. 1, 2020

(65) Prior Publication Data

US 2021/0173347 A1 Jun. 10, 2021

(30) Foreign Application Priority Data

Dec. 10, 2019 (EP) ..... 19214813

(51) Int. Cl.
*G04C 3/00* (2006.01)
*G04B 3/04* (2006.01)
(Continued)

(52) U.S. Cl.
CPC ..... *G04C 3/002* (2013.01); *G04B 3/046* (2013.01); *G04G 21/08* (2013.01); *G04F 10/00* (2013.01)

(58) Field of Classification Search
CPC ..... G04F 10/00; G04B 3/046; G04G 21/08; G04G 21/00; G04C 3/005; G04C 3/002;
(Continued)

(56) References Cited

U.S. PATENT DOCUMENTS 9,898,032 B2 * 2/2018 Hafez ..... G06F 3/0362
10,474,194 B1 * 11/2019 Ell ..... G06F 1/1633
(Continued)

FOREIGN PATENT DOCUMENTS

CN 109791392 A 5/2019
EP 0 919 959 A1 6/1999
(Continued)

OTHER PUBLICATIONS

European Search Report dated Jun. 11, 2020 in European Application 19214813.8 filed Dec. 10, 2019 (with English Translation of Categories of Cited Documents), citing documents AA-AH and AO-AS therein, 6 pages.

*Primary Examiner* — Edwin A. Leon
(74) *Attorney, Agent, or Firm* — Oblon, McClelland, Maier & Neustadt, L.L.P.

(57) ABSTRACT

A watch including a control member that is able to manage at least one first function of the watch and at the same time to control one or more additional electronic functions. The control member, for example a crown or a push-piece head, is mounted on the elongate element defining a central axis and passing through a wall of the watch middle. At least one strain gauge is mounted around the elongate element and arranged so as to produce an electrical signal representing a radial force exerted by the elongate element on the strain gauge when a user laterally exerts a force on the control member. A processor generates at least one command on the basis of the electrical signal, for example to enable the user to navigate in a menu or a calendar displayed on a digital screen.

14 Claims, 3 Drawing Sheets

(51) Int. Cl.
*G04G 21/08* (2010.01)
*G04F 10/00* (2006.01)

(58) Field of Classification Search
CPC ..... G04C 3/007; G06F 3/0362; G06F 3/0346; G01D 5/2412
See application file for complete search history.

(56) References Cited

U.S. PATENT DOCUMENTS

| | | | | |
|---|---|---|---|---|
| 11,194,298 | B2 * | 12/2021 | Roach ..... | G04G 21/025 |
| 2014/0169144 | A1 | 6/2014 | Briswalter et al. | |
| 2018/0018026 | A1 | 1/2018 | Bushnell et al. | |
| 2018/0024683 | A1 | 1/2018 | Ely et al. | |
| 2018/0307363 | A1 | 10/2018 | Ely et al. | |
| 2018/0341342 | A1 | 11/2018 | Bushnell et al. | |
| 2018/0364815 | A1 | 12/2018 | Moussette et al. | |
| 2019/0072912 | A1 | 3/2019 | Pandya et al. | |
| 2019/0250754 | A1 | 8/2019 | Ely et al. | |
| 2019/0302902 | A1 | 10/2019 | Bushnell et al. | |
| 2020/0110473 | A1 | 4/2020 | Bushnell et al. | |
| 2020/0150815 | A1 | 5/2020 | Ely et al. | |

FOREIGN PATENT DOCUMENTS

| | | | |
|---|---|---|---|
| EP | 1 091 269 | A1 | 4/2001 |
| EP | 1 168 113 | A1 | 1/2002 |
| EP | 3 008 552 | A1 | 4/2016 |
| WO | WO 2014/200766 | A1 | 12/2014 |
| WO | WO 2018/022254 | A1 | 2/2018 |

* cited by examiner

WATCH PROVIDED WITH A CONTROL MEMBER

CROSS-REFERENCE TO RELATED APPLICATION

This application claims priority to European Patent Application No. 19214813.8 filed on Dec. 10, 2019, the entire disclosure of which is hereby incorporated herein by reference.

TECHNICAL FIELD

The invention relates to a watch provided with at least one electronically manageable function and provided with a control member for controlling this function.

TECHNOLOGICAL BACKGROUND

Mechanical or electromechanical watches comprise as standard a crown and arbor that makes it possible to adjust the position of the hands by turning the crown, as well as winding the barrel in the case of mechanical watch. In the majority of cases, the crown is in an idle position situated close to the watch case, and it is necessary to pull it towards an adjustment position in order to adjust the time and, where necessary, the date.

More and more additional features are provided, such as an electronic display of personal and/or geographical information, for example a diary and fitness and geolocation data. This is the case also with watches equipped with a mechanical movement, for example by adding an electronic module comprising a digital screen arranged on a part of the dial.

The presence of the aforementioned additional features generally requires specific control means, which make it possible for example to select a function, to navigate in a menu, etc.

Electronic watches have been developed with a control member of the joystick or trackball type. Examples of these solutions are respectively illustrated by the documents EP 1168113 and EP 0582150. However, it should be noted that these solutions are not provided for a watch with mechanical winding. The document EP 0582150 also describes a watch provided with a crown and arbor as well as a trackball device. The disadvantage of the latter solution is that the presence of two control members spatially separated is not always desirable from an aesthetic point of view and/or from an economic point of view since the watch case is more complex to machine. It should also be noted that good water-resistance of the watch case is more difficult to obtain with control members of the joystick or trackball type described in the aforementioned prior documents.

SUMMARY OF THE INVENTION

The invention aims to provide a watch that does not suffer from the drawbacks described above. This aim is achieved by the watch according to the accompanying claims.

A watch according to the invention comprises a control member able to manage at least one first function of the watch and at the same time to control one or more additional electronic functions. The control member, for example a rotary crown, is mounted on an elongate element defining a central axis and passing through the middle of the watch. At least one deformation gauge, also referred to as a strain gauge, is mounted inside the middle and arranged so as to produce an electrical signal that represents a force exerted by the elongate element on the deformation gauge when a user manipulates the control member in at least one direction perpendicular to said central axis. A process generates commands on the basis of the signals from the gauge or gauges, for example to enable the user to navigate in a menu displayed on a digital screen.

BRIEF DESCRIPTION OF THE FIGURES

The invention will be described below in more detail by means of the accompany drawings, given by way of in no way limitative examples, wherein.

La

DETAILED DESCRIPTION OF AN EMBODIMENT OF THE INVENTION

The invention applies both to watches provided with a mechanical movement and those with an electromechanical movement. It can even apply to an electronic watch without hands.

In the case of a mechanical movement, the watch is provided with additional features with an electronic character. This watch may include a digital screen that extends over a portion of the dial, provided for displaying time by means of hands, and on which various data are displayed, such as the date, the time, alphanumeric messages or other information accessible for example by navigating in one or more menus. The watch comprises a crown and arbor mechanism for winding and adjusting the hands, well known in the prior art. According to this embodiment of the invention, the crown also serves as a means for controlling additional electronic functions, by means of a set of deformation/strain gauges mounted so as to be able to detect the manipulation of the crown in two dimensions in a plane perpendicular to the rotation axis of the crown, or more precisely to detect a pressure exerted laterally by a user on the crown in two directions orthogonal to each other and perpendicular to the central axis of the crown and arbor mechanism.

Figure 1:
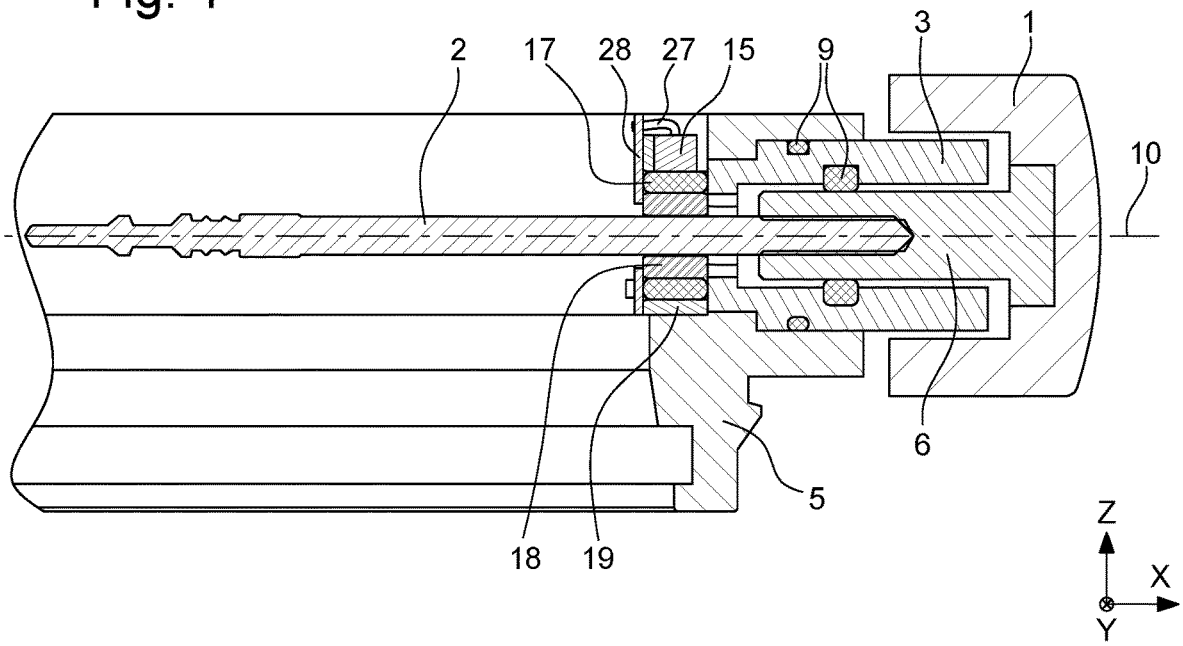
FIG. 1 shows a vertical section of the crown and arbor mechanism incorporating a joystick feature in a watch according to an embodiment of the invention.
Figure 2:
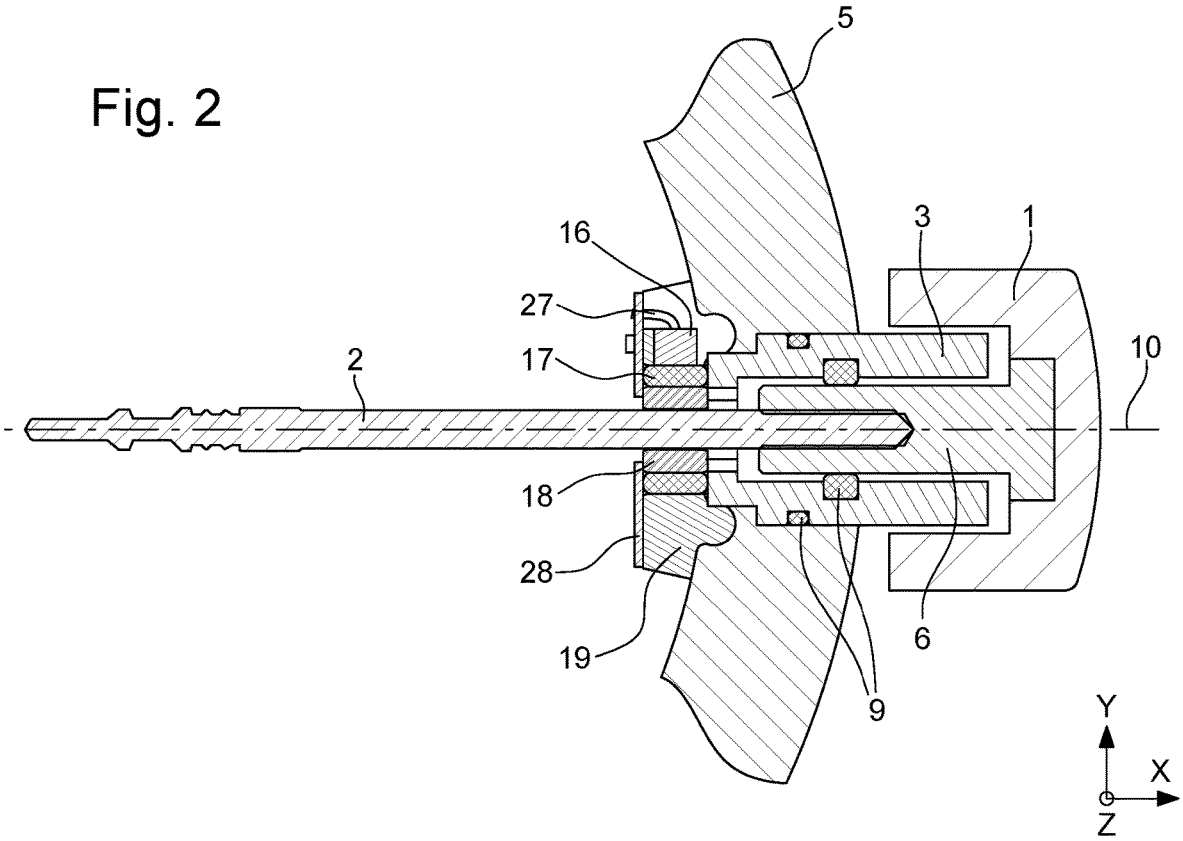
FIG. 2 shows a horizontal section of the same mechanism as in FIG. 1.
Figure 3:
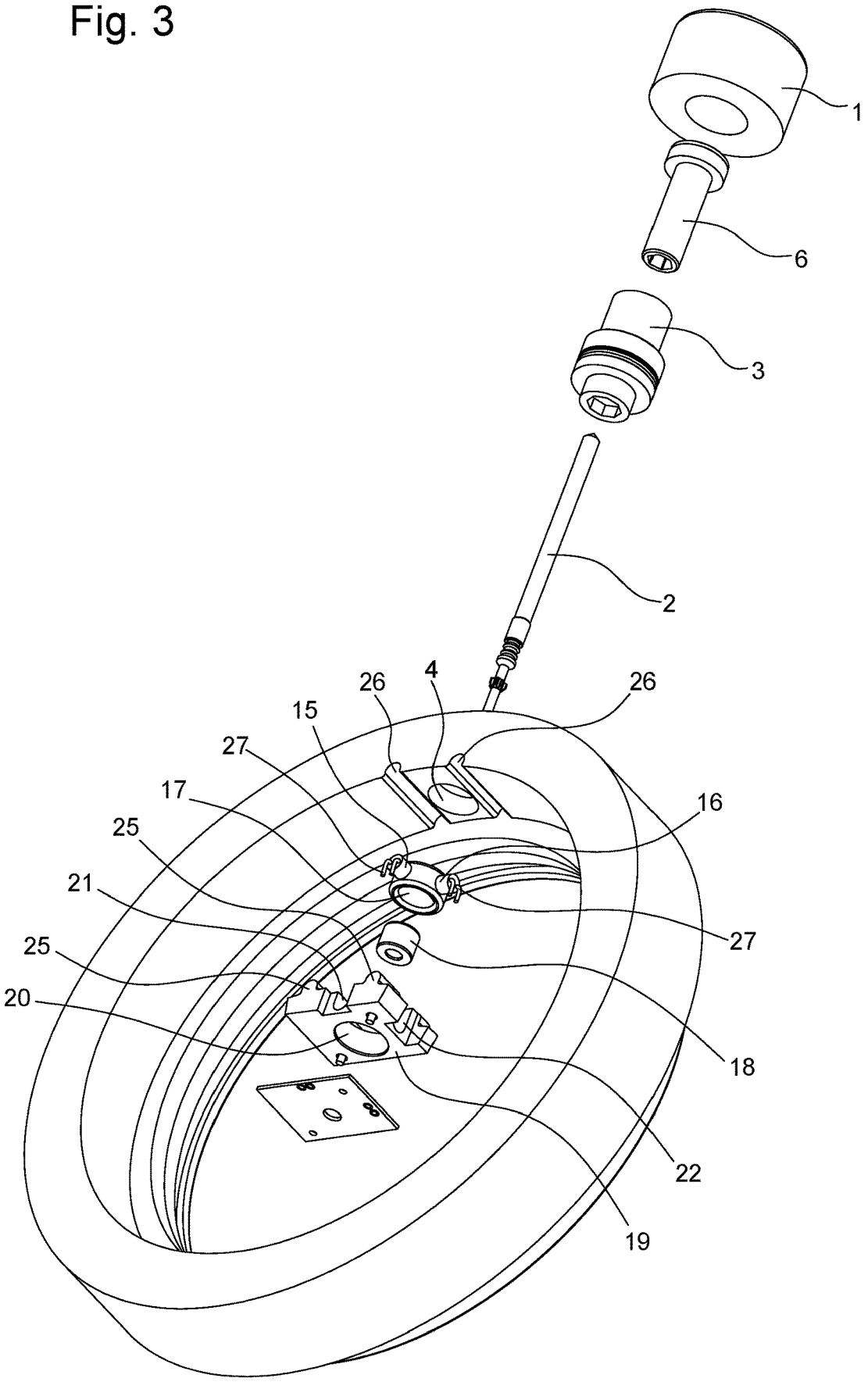
FIG. 3 shows an exploded view of the mechanism in FIGS. 1 and 2.
Figure 4:
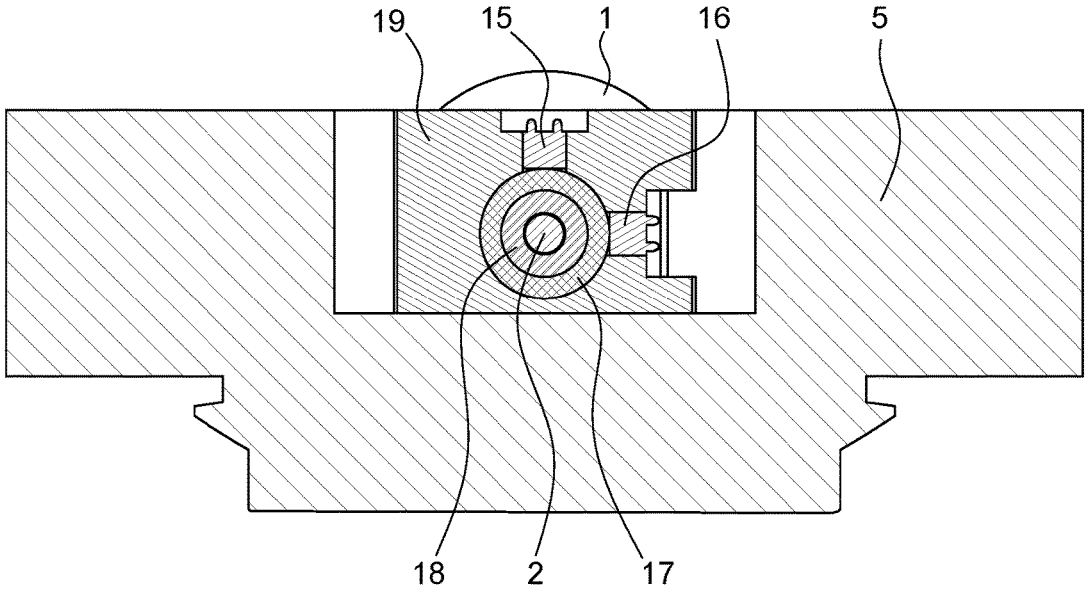
FIG. 4 is a cross section perpendicular to the central axis of the crown and arbor forming the mechanism shown in FIGS. 1 to 3.
Figure 5A:
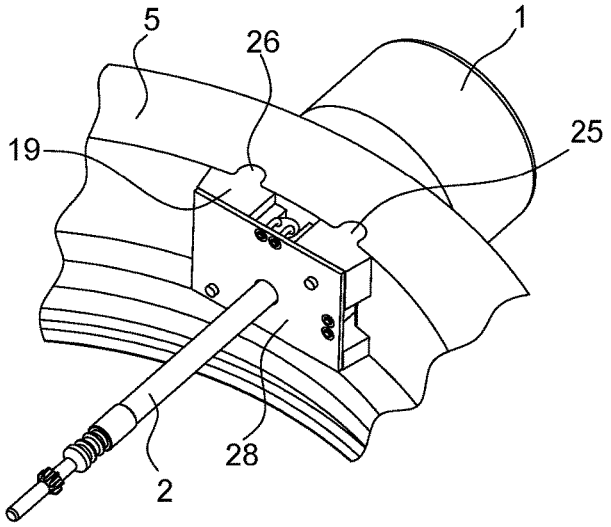
FIG. 5A is a view in perspective of a module incorporating two deformation gauges and arranged inside the watch middle.
Figure 5B:
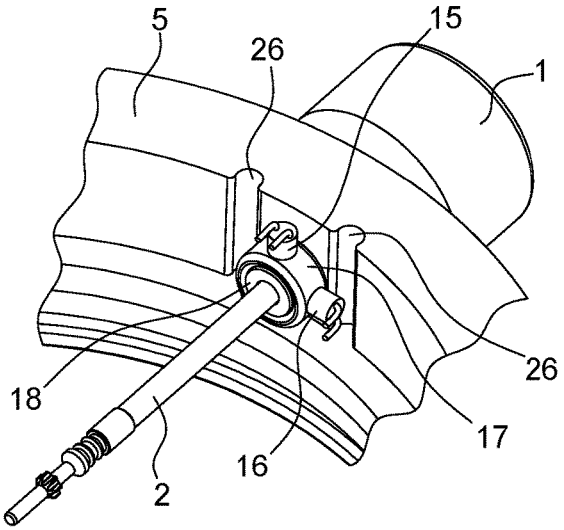
FIG. 5B is a view in perspective showing an internal part of the module in FIG. 5A, in particular the two deformation gauges.

FIGS. 1 and 2 show vertical and horizontal sections of the crown and arbor mechanism in a watch according to an embodiment of the invention. In FIG. 3, the various components are displayed in an exploded view. In a known manner, the crown 1 is connected to a winding arbor 2 by means of an arbor coupling 6 driven on an end of the arbor 2. The assembly consisting of the arbor 2 and the arbor coupling 6 passes through a tube 3 mounted fixedly in a hole 4 provided in the wall of the watch middle 5. In the finished watch, the middle 5 forms a support in which a horological movement is installed that is adjustable by the crown and arbor mechanism. O-ring seals 9 are inserted between the tube 3 and the middle 5 and between the tube 3 and the arbor coupling 6 in order to ensure water-resistance of the mechanism. The crown 1 is mounted on one side of the arbor coupling 6, so that rotation of the crown 1 rotates the arbor coupling 6 and the arbor 2 about the rotation axis 10.

The assembly consisting of arbor coupling 6 and arbor 2 represents an embodiment of an elongate element to which the crown is attached. It should be noted that this assembly can take various forms according to the type of watch. In particular, the arbor coupling and arbor may form a single element. In the case of a purely digital watch, it is possible to provide a rotary crown fixed to an elongate element forming an electronic arbor. In general terms, the elongate element is an element that defines a central axis 10 and which projects out of the watch middle 5.

In addition, the crown 1 is merely one embodiment of a control member mounted laterally with respect to the middle and to which the invention is applicable. Another example of such a control member is the head (generally non-rotary) of a push-piece equipping a chronograph. In general terms, the control member to which the invention is applicable is a member that is configured to adjust at least one first function, and which is adapted according to the invention for adjusting one or more additional electronic functions. The invention will be described for the case of the rotary crown, which represents the most usual case in the horological field but which does not limit the scope of the invention.

In the figures, the crown 1 is shown in a positive relatively close to the middle 5, referred to as the "idle position". As is known per se, this position makes it possible for example for the user of a mechanical watch to wind his watch manually by rotating the crown. According embodiments, and as is also known, the crown may be distant from the middle 5, by manually pulling this crown and driving the arbor 2 in the axial direction, in order to activate mechanical adjustment modes such as the adjustment of the position of the hands and, where applicable, the date. Various systems exist that adjust the axial positioning of the crown and the actuation of the mechanical adjustment, and the invention is applicable in combination with any one of these systems. Independently of the system applied, the invention relates to functions provided for a control member such as the crown 1 when the latter is preferably situated in the idle position.

As illustrated in the figures, a pair of strain gauges 15 and 16 is mounted inside the middle 5. The gauges are able to measure the radial force exerted by the arbor 2 when the user manipulates the crown 1 in the plane YZ of the system of orthogonal axes XYZ, wherein the axis X is colinear with the rotation axis 10 of the arbor 2. More particularly, the axis Z is essentially perpendicular to the general plane of the middle 5, and Y is in this general plane. In fact, in the present case, the joystick function is more closely related to the result, namely the possibility of directing a slide-contact in a plane or activating various zones of a digital display distributed according to the two dimensions of this digital display, since the movement of the crown 1 in a plane YZ is relatively limited and, in a particular variant, almost zero. This is because it is the force exerted laterally on the crown and which is transmitted to the arbor 2 that is detected via the radial force applied by this arbor at the two strain gauges.

In order to measure the radial force, the gauges 15 and 16 are mounted at the periphery of an O-ring 17 made from resilient material, at radial positions separated by an angle of 90° to the rotation axis 10. The ring 17 is mounted around a washer 18 made from rigid material. The arbor 2 passes through the washer 18. The clearance between the washer and the arbor is provided so as to be minimal, while allowing sliding of the arbor 2 with respect to the washer, so that user can pull the crown 1 and the arbor 2 towards a position of adjusting the time and once again towards the idle position. The gauges 15 and 16 are immobilised by a support 19 that is fixed to the inner surface of the side wall of the middle 5, for example by screws (not shown). The support 19 comprises an opening 20 the diameter of which corresponds to the diameter of the O-ring 17 so that the ring comes to be housed in the opening 20. In addition, the support 19 is provided with two radial beds 21 and 22 positioned at an angle of 90° to the circumference of the opening 20, and sized so as to receive the respective gauges 15 and 16 and to maintain them at fixed positions with respect to the arbor 2.

According to the embodiment shown in the figures, the support 19 comprises two vertical ribs 25 that are housed in a pair of grooves 26 in the inner wall of the middle 5, so as to lock the support 19 in a fixed position. In equivalent embodiments, other locking means may be implemented.

The gauges 15 and 16 are maintained in contact with the resilient ring 17 with a certain degree of prestressing, so that a basic stress is measured when the crown 1 is situated in an idle position and in the absence of manipulations by the user. From this idle position, the radial forces, exerted on the arbor 2 by the manipulations of the crown in the plane YZ, are transmitted as radial forces exerted by the washer 18 on the ring 17, which are added to or are deducted from the basic prestressing, according to the direction of the manipulations, on the two orthogonal axes Y and Z defined respectively by the two strain gauges 16 and 15. In this way, the signals generated by the gauges 15 and 16 are representative of the manipulations of the crown on two dimensions (Y and Z), which gives to the crown functions similar to those of a joystick of a control console for a computer.

The gauges 15 and 16 are connected by electric wires 27 to a printed circuit board (PCB) 28, attached to the rear face of the support 19. A processor (not shown) is on board the PCB 28 in order to process the signals generated by the strain gauges and to translate them into commands that will manage one or more electronic functions of the watch, for example the control of a cursor on the digital screen of the watch. It is possible to implement methods and algorithms well known in the computing field for processing signals as well for generating commands. A battery or other source of electrical energy, such as a photovoltaic cell, is present in the watch to supply the components mounted on the PCB 28 and/or other electronic components implemented in the watch.

Preferably, the gauges 15 and 16 are positioned orthogonally with respect to each other. A deviation from this orthogonal positioning is permitted provided that the forces exerted in the directions Y and Z can be derived from the signals measured, taking account of the angular position of the gauges in a plane parallel to the plane YZ.

The invention is not limited to embodiments provided with two strain gauges. A watch according to the invention could comprise a single gauge arranged so as to be able to measure a manipulation in a single direction, for example solely the gauge 15. It can also be envisaged providing more than two gauges, for example four situated at four points around the axis of the crown, corresponding in particular to the angles 0°, 90°, 180° and 270°.

Among the embodiments provided with at least two strain gauges, particular embodiments are for example the attribution of specific functions according to the direction in which the control member is manipulated in a plane perpendicular to the central axis 10. For example, in the case of the embodiment shown in the figures, manipulation on the axis Z, detected solely by the gauge 15, will be able to control a different function than manipulation on the axis Y, detected solely by the gauge 16. In this case, the processor is preferentially configured so that a slight deviation of the manipulation with respect to the axes Y and Z will be ignored.

According to a variant embodiment, a module comprising the gauges is arranged at least to a major extent in a bed machined in the wall of the middle around the opening for the arbor 2 and the arbor coupling 6, for example in the tube 3. In another variant embodiment, the strain gauges are arranged in an internal setting of the tube 3, for example on the same side as the outer end of this tube, the gauges then detecting the radial forces exerted on them by the arbor coupling 6 when the crown 1 is manipulated in the two directions Y and Z. However, the variant shown is preferred to the latter variant since, in the variant shown, the measuring module is situated in the impervious part of the watch case and electrical connections between this measuring module and other units of the watch, in particular an electronic display module, are facilitated.

The ring 17 is only one embodiment of a resilient interface, which could take other equivalent forms, for example including two parts made from resilient material mounted between the gauges and the washer 18. Next, the washer 18, although advantageous, is not essential. On the other hand, in order to have prestressing exerted on the gauges while having the arbor 2 free in its axial movement, the washer made from hard material is useful.

According to other embodiments, the crown 1 (or any other control member to which the invention is applicable) is capable of undergoing an auto-reversible axial movement from the idle position, like a chronograph push-piece. This axial movement is actuated by the user, who pushes the crown briefly towards the middle 5 and then releases the crown, which automatically returns to the initial position thereof. This can be achieved for example when the crown 1 is connected to the arbor 2 via a spring push-piece mechanism, known per se. According to the embodiments that are relevant for the invention, the watch is provided with a detector arranged to detect this axial movement so that the processor generates in response a specific command different from the commands generated by the radial manipulation of the crown. The commands generated by the thrust of the crown may be commands confirming a selection among options presented for example in a menu. The reversible thrust may also be used equally to activate or deactivate the joystick feature of the crown. The duration of the thrust may determine the command. For example, a longer duration for activation or deactivation of the joystick feature and a shorter duration for confirming a selection as soon as the feature is active.

Various types of proximity detector can be used for detecting the approach of the crown towards the middle. For example, a pair of galvanic contacts could be provided, which touch each other when the crown is pushed, or more advantageously a capacitive detector could be implemented. Another possibility is a magnetic detector with variable reluctance comprising a magnetic piece integrated in the wall of the middle and provided with a solenoid in which the current generated at a given voltage is dependent on the distance between the magnetic piece and the inner face of the crown, which is manufactured at least partially from a ferromagnetic material.

The invention claimed is:

1. A watch comprising a watch case that comprises:

a middle, a horological movement inside the middle, and a control member mounted laterally with respect to the middle;

the control member being mounted at the outer end of an elongate element that projects out of the middle, said elongate element defining a central axis, the control member being configured to fulfil at least one first function of the watch via a rotation or an axial movement of the elongate element, the watch being provided with at least one additional function that can be managed by an electrical signal; wherein the watch comprises:

at least one strain gauge mounted inside the middle or at least partially in said middle or in an external element fixedly connected to said middle, said strain gauge and the elongate element being arranged so that the elongate element can exert a radial force on said strain gauge when a sufficient actuation force is exerted by a user on the control member in at least one direction substantially perpendicular to said central axis, said strain gauge being arranged so as to produce the electrical signal that is dependent on the radial force and thus on said actuation force, and a processor configured to generate a command that manages said additional function based on the electrical signal generated by the strain gauge.

2. The watch according to claim 1, wherein said at least one strain gauge is immobilized with respect to the middle and mounted against a resilient interface that is arranged between the elongate element and said at least one strain gauge.

3. The watch according to claim 2, wherein said resilient interface takes a form of an O-ring centred on said central axis.

4. The watch according to claim 2, wherein a washer made from rigid material is mounted around the elongate element, which is left free in axial translation, and between said elongate element and the resilient interface, the strain gauge being mounted so as to be prestressed against the resilient interface.

5. The watch according to claim 2, wherein the watch comprises a support that immobilizes said at least one strain gauge with respect to a wall of the middle or with respect to the horological movement, the support comprising an opening for passage of the elongate element and at least one bed for receiving said at least one strain gauge.

6. The watch according to claim 1, wherein the watch comprises two strain gauges mounted orthogonally in relation to said central axis.

7. The watch according to claim 6, wherein distinct functions of the watch are managed by manipulations of the control member in respective distinct directions, said distinct directions being defined by the angular position of the strain gauges.

8. The watch according to claim 1, wherein the control member is capable of undergoing an axial auto-reversible movement with respect to the middle, the watch including at least one proximity detector, arranged so as to be able to detect said axial movement, and the processor is configured to generate, in response to said axial movement, a command that is different from the commands generated by manipulation of the control member in said at least one direction substantially perpendicular to the central axis.

9. The watch according to claim 8, wherein a command generated by the detection of said axial movement is the activation or deactivation of the function of said at least one strain gauge.

10. The watch according to claim 8, wherein a command generated by the detection of said axial movement is the confirmation of a selection.

11. The watch according to claim 1, wherein the control member is a rotary crown arranged so as to rotate the elongate element about the central axis when a user turns the crown in order to execute said first function.

12. The watch according to claim 11, wherein the elongate element includes an assembly consisting of an arbor and an arbor coupling, the crown being mounted at the outer end of the arbor coupling.

13. The watch according to claim 1, wherein the control member is a push-piece, said first function of which is to activate a feature of a chronograph with which the watch is equipped.

14. The watch according to claim 1, wherein the horological movement is mechanical.

* * * * *